US005400874A

United States Patent [19]

Gayfer et al.

[11] Patent Number: 5,400,874

[45] Date of Patent: Mar. 28, 1995

[54] SINGLE ACTUATOR TRUCK MOUNT BRAKE SYSTEM

[75] Inventors: Robert Gayfer; Zdzislaw Samulak, both of Watertown, N.Y.

[73] Assignee: Knorr Brake Holding Corp., Westminster, Md.

[21] Appl. No.: 118,719

[22] Filed: Sep. 10, 1993

[51] Int. Cl.[6] ..... B61H 13/00

[52] U.S. Cl. ..... 188/52; 188/197

[58] Field of Search ..... 188/52, 197, 205 R, 188/205 A, 53, 54, 198, 202, 219.1, 217, 220.1

[56] References Cited

U.S. PATENT DOCUMENTS

| | | | |
|---|---|---|---|
| 3,177,984 | 4/1965 | Taylor | 188/197 |
| 3,298,474 | 1/1967 | Roselius et al. | 188/52 X |
| 3,378,108 | 4/1968 | McClure et al. | 188/52 |
| 3,406,791 | 10/1968 | Williams | 188/52 |
| 3,499,507 | 3/1970 | Scott et al. | 188/52 |
| 3,731,766 | 5/1973 | Campbell | 188/52 |
| 4,128,148 | 12/1978 | Schmitt | 188/52 X |
| 4,613,016 | 9/1986 | Hart et al. | 188/52 |
| 4,653,812 | 3/1987 | Engle | 303/33 |
| 4,716,995 | 1/1988 | Nilsson et al. | 188/197 |
| 4,771,868 | 9/1988 | Haydu | 188/52 |
| 4,793,446 | 12/1988 | Hart et al. | 188/52 |
| 5,069,312 | 12/1991 | Kanjo et al. | 188/52 |
| 5,259,485 | 11/1993 | Jackson | 188/52 X |

*Primary Examiner*—Robert J. Oberleitner
*Assistant Examiner*—Peter M. Poon
*Attorney, Agent, or Firm*—Barnes & Thornburg

[57] ABSTRACT

A brake system wherein the single actuator is freely mounted to a first brake beam so as to align its force application axis with the axis of a first force transmitting rod connected at its other end to a transfer lever on a second brake beam. A second force transmitting rod connects the transfer lever back to the first brake beam. The mounts for the actuator and the transfer lever are designed for use with brake beams of dual actuator brake systems.

16 Claims, 2 Drawing Sheets

SINGLE ACTUATOR TRUCK MOUNT BRAKE SYSTEM

BACKGROUND AND SUMMARY OF THE INVENTION

The present invention relates to truck-mounted brakes for a railroad vehicle and more particularly to an improved single actuator, truck mounted brake.

The accepted truck mounted brakes throughout the railroad industry approved by AAR is a double actuator system known as NYCOPAC sold by New York Air Brake Corporation and its equivalent WABCOPAC sold by Westinghouse Air Brake Corporation. Two actuators are used, one connected to each brake beam on opposite sides of the center axis. An example of the structure is illustrated in U.S. Pat. No. 3,499,507. The next generation of truck mounted brake includes a single actuator, truck mounted brake assembly known as WABCOPAC II. This structure includes a single actuator with a pair of force transmitting arms and a lever connected to the opposite brake beam. A typical example of this structure is illustrated in U.S. Pat. No. 4,793,446.

As illustrated in U.S. Pat. No. 3,499,507, the slack adjuster is provided on the opposite end of the force transmitting device from the actuator and in the opposing brake beam. The NYCOPAC and WABCOPAC have no slack adjuster. In the single actuator system illustrated in U.S. Pat. No. 4,793,446 the slack adjuster is on the return force transmitting device. As discussed therein, it is important that the force transmitting elements and the slack adjuster do not intersect the openings in the bolster for the various angular positions of the force transmitting elements.

The single actuator, truck mounted brake provides a force generated by the brake cylinder multiplied by a factor of four. This system is very effective as a force generated by the brake cylinder is transferred to the center of the arc of each of the shoes equally. The center of the force in the middle of each of the shoes eliminates wasted torsional components that exist in other systems. In extreme arc conditions, the piston in the force actuator is forced to rotate with respect to the cylinder. This provides unnecessary wear and tear on the packing cup and in severe cold weather conditions could cause leakage. Also, the two brake beams are not maintained parallel during operating conditions, providing further deviations in the arc.

A substantial number of cars are equipped with the dual actuator, truck mounted brake, and thus there is a need to provide a single actuator, truck mounted brake system which can be used on existing equipment which was manufactured using dual actuators.

Thus, it is an object of the present invention to provide an improved single actuator, truck mounted brake system which accommodates for extreme arc conditions and severe cold weather.

Another object of the present invention is to provide a single actuator, truck mounted brake system which may be retro-fitted onto existing dual actuator, truck mounted brakes.

These and other objects are attained by mounting a single actuator to a first brake beam in such a manner that the actuator's force transmitting axis is freely maintained coaxial with the transmitting axis of the first force transmitting element which is connected at its other end to a transfer lever on a second brake beam. A second force transmitting element connects another arm of the transfer lever back to the first beam. The mounting structure allows the actuator to rotate about two orthogonal axis. Preferably the mounting structure is a cage which is pivotally rotated to the first brake beam to rotate about the first axis and the actuator is pivotally mounted to the cage to rotate about a second orthogonal axis. The actuator is mounted exterior the first brake beam and includes a slack adjuster extending through the first beam to connect the actuator to the first force transmitting element.

To convert a dual actuator brake system to a single actuator brake system using the previously described elements, the actuator with the first force transmitting elements extending therefrom is mounted at an actuator aperture of the first brake beam using the mounting holes about the periphery of the actuator aperture. The first force transmitting element extends through an opposed force transmitting aperture in the second brake beam. A transfer lever is pivotally mounted to the second brake beam by a bracket using the mounting holes about the actuator aperture of the second brake. The bracket includes an aperture which aligns with the actuator aperture of the second brake beam. The first transmitting element is connected to an arm of the transfer lever. A second force transmitting element is extended through the actuator aperture of the second brake beam and into the force transmitting aperture of the first brake beam. The second force transmitting element at one end is connected to an opposite arm of the transfer lever and its other end is connected to the first brake beam at the force transmitting aperture of the first brake beam using the existing mounting holes.

Other objects, advantages and novel features of the present invention will become apparent from the following detailed description of the invention when considered in conjunction with the accompanying drawings.

DESCRIPTION OF THE PREFERRED EMBODIMENT

Figure 1:
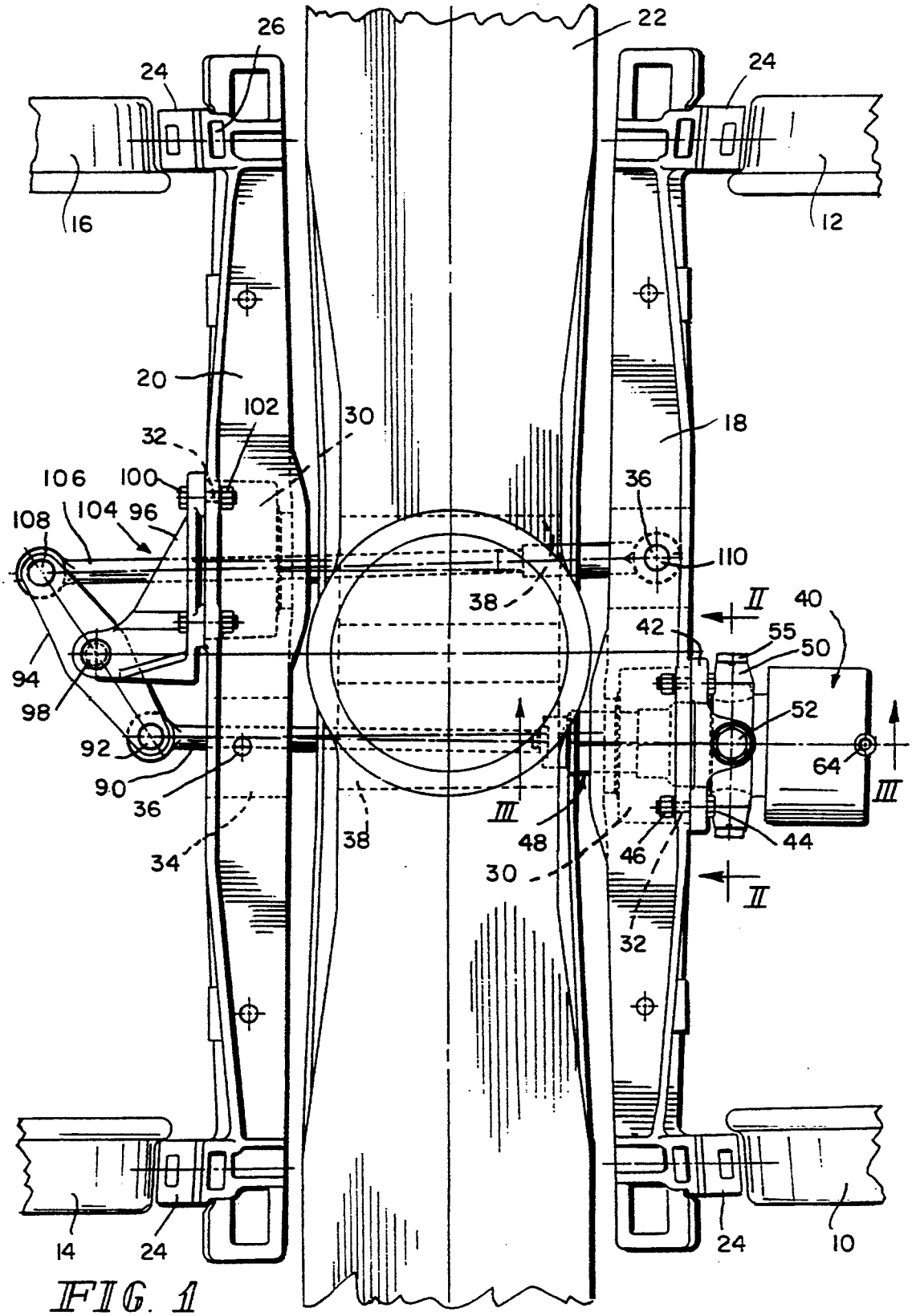
FIG. 1 is a plan view of a brake system incorporating the principles of the present invention.

A brake system for a railroad vehicle is illustrated in FIG. 1. Although the description of the system will be provided with respect to conversion of existing dual actuator, truck mounted brake systems, the present mounting structure of the single actuator is also applicable to any other truck mounted brake system or any other brake system. The existing structure of the dual actuator, brake mounted system will be described first and will be followed by the specific elements of the present system which is mounted thereto. Two pairs of wheels 10/12 and 14/16 are secured to opposites ends of a respective axle, not shown for sake of clarity, of a two-axle, four wheel railroad car truck. A pair of brake beams 18 and 20 extend crosswise of the car truck and parallel to each other and to a truck bolster 22. Brake shoes 24 are mounted to the brake head 26 at each end of the brake beams 18 and 20. The brake beams 18 and 20 have a generally U-shaped cross section. A non-pressurized head of a brake cylinder or actuator 30 is integrally formed with each of the brake beams 18 and 20 and has a plurality of mounting holes 32 about the periphery thereof. The head 30 is to be referred to as an actuator aperture. The remainder of the actuator, including the pressurized portion and piston, are mounted to head portion 30 by fasteners through the apertures 32. On the other side of the center line of each of the brake beams 18 and 20 is a force transmitting aperture 34 for receiving the other end of the force transmitting elements. A pair of opposed mounting holes 36 on the top and bottom portion of the flange are used to mount slack adjusters in the apertures 34 or the end of a force transmitting arm of the prior art. The bolster 22 includes a pair of channels 38 on each side of the center axis and aligned with the opposed pair of actuator aperture 30 and the force transmission aperture 34.

In a dual actuator, truck mounted brake, an actuator or brake cylinder is mounted in each of the brake cylinder heads or actuator apertures 30 with a force transmitting element or pushrod extending through channels 38 in the bolster 22 and received in a slack adjusting element in aperture 34 of the opposed beam. The present brake system includes a brake actuator or cylinder 40 mounted to the brake beam 18 at the actuator aperture 30 by a bracket 42 and an intermediate cage 50. Bolts 44 extend through the elongated openings 43 (FIG. 2) in the bracket 42 and the mounting holes 32 in the brake beam 18 and is secured thereto by nuts 46. A slack adjuster 48 extends from the cylinder 40 and lies in and extends through the actuator aperture 30 in the beam 18. The slack adjuster will be discussed in detail with respect to FIG. 3.

Figure 2:
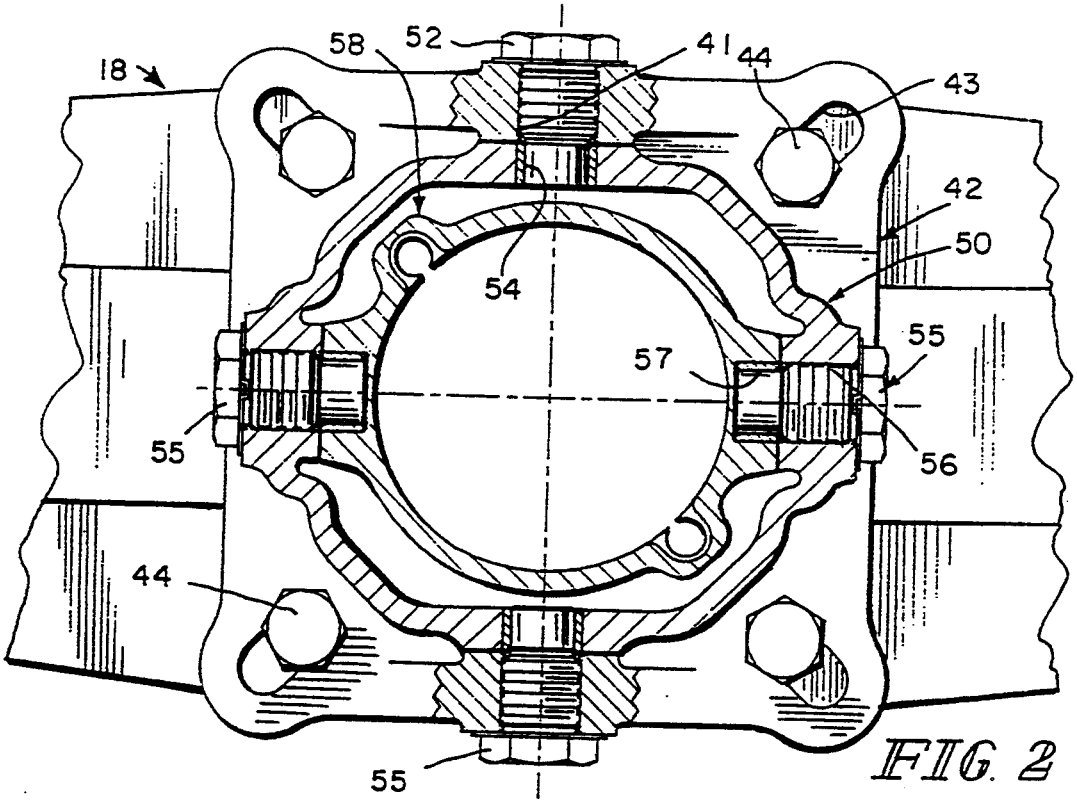
FIG. 2 is a cross sectional view of the mounting of the actuator to the brake beam taken along lines II—II of FIG. 1.

The cage 50 mounts the actuator brake cylinder 40 to the brake beam 18 so that it freely rotates about two orthogonal axis to provide two axis of adjustment about the center axis of the aperture 30 and may be considered a gimbal. As illustrated in FIG. 2, the cage 50 is mounted to the bracket 42 by fasteners 52 which are threadably received in aperture 41 of the bracket 42 and extend into a sleeve bearing 54 in the cage 50. A non-pressurized cylinder portion 58 is mounted to the cage 50 by a fastener 55 threadably received in a bore 56 of the cage 50 and having an end extending into bearing sleeve 57 in the cylinder portion 58.

Figure 3:
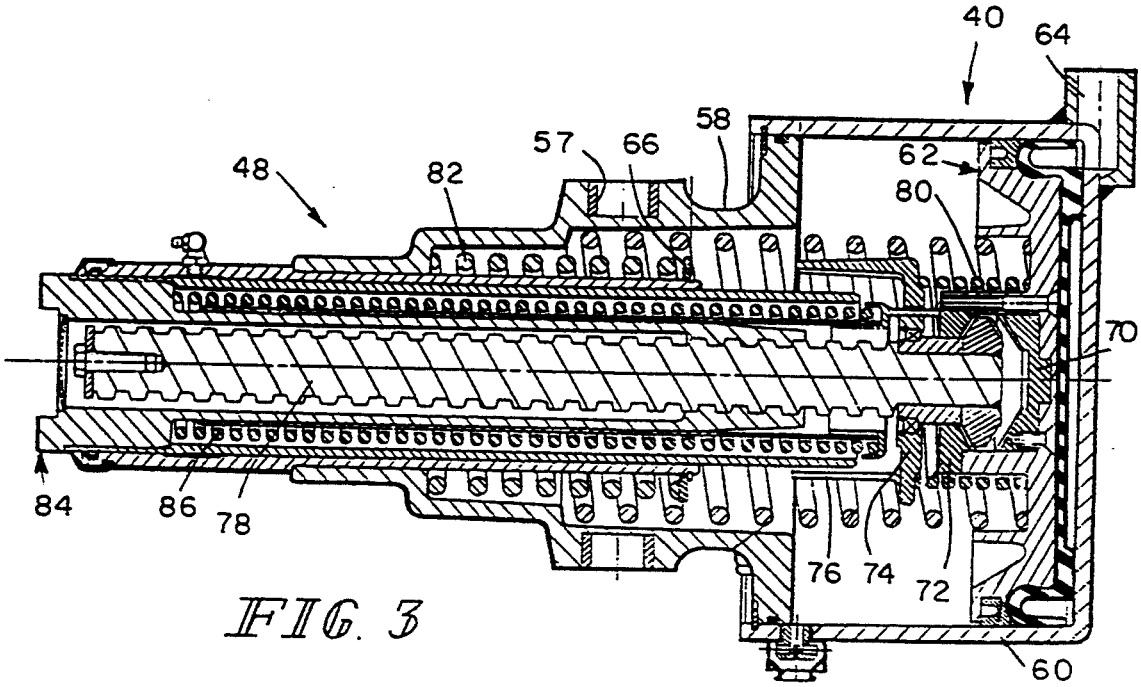
FIG. 3 is a cross sectional view of the actuator with slack adjuster taken along lines III—III of FIG. 1.

As illustrated in FIG. 3, the brake cylinder actuator 40 includes a head portion 60 which receives at one end the cylindrical portion 58 and includes a piston 62 dividing the interior of head 60 into a pressurized and unpressurized volumes. A port 64 admits the fluid pressure to move the piston to the left to operate the brakes. Spring 66 resting at one of its ends on the housing portion 58 and biases the piston 62 to the right or brake release position.

The slack adjuster 48 includes a back female clutch 70 at the piston 62, a front female clutch 72, a bearing 74 and a bearing cup 76. A compensator screw 78 with head clutch is received in the front female clutch 72. Slack adjuster spring 80 rests between the piston 62 and the bearing cup 76. A second slack adjuster spring 82 rest between the actuator housing 58 and a flange on ram 84. A ram spring 86 extends between ram 84 and a portion of the front female clutch 72. The slack adjuster 48 is a double acting slack adjuster integral with the actuator 40 or brake cylinder.

A first force transmission element or rod 90 extends from the slack adjuster 48 at ram portion 84 through the channel 38 in the bolster 22 and the force transmitting aperture 34 in the second brake beam 20. The rod 90 is connected at its other end by pin 92 to a first arm of transfer lever 94. A pin 98 pivotally mounts the transfer lever 94 to a bracket 96 which is connected to the brake beam 20 by fasteners 100 extending through the mounting holes 32 and nuts 102. The bracket 96 has an aperture 104, not shown, which aligns with the actuator aperture 30 in the beam 20. A second force transmitting element or rod 106 has its first end connected to a second arm of the transfer lever 94 by a pin 108. The force transmitting rod 106 extends through the aligned aperture 104 in bracket 96 and the aperture 30 in brake beam 20, through channel 38 in the bolster 22 and into the force transmitting aperture 34 of the first brake beam 18. A pin 110 extends through the pre-existing mounting hole 36 in the beam 18 to connect the other end of the force element 106 to the first brake beam 18.

The cage 50 and its connection to the first brake beam 18 allows the actuator 40 to freely maintain its axis of force application coaxial with the axis of the first force transmitting element or rod 90. This prevents twisting and bending of the piston 62 and possible damage to the slack adjuster 48 during the arc movement of the force transmitting rod 90 as well as any non-parallelness of the brake beams 18 and 20 to each other. Although the bracket 42 has been shown to be mounted to the preexisting mounting holes for a dual actuator beam system, it can be mounted to any brake beam.

Bracket 96 is configured such that it can be used with the preexisting mounting holes 32 while positioning the attachment of the transfer lever 94 to pivot about pin 98 at a center line midway between the axis of the opposed pairs of actuator apertures 30 and force transmitting apertures 36 in the brake beams. The aperture 104 in the bracket 96 allows the beam second force transmitting element 106 to extend therethrough while allowing the use of the preexisting mounting holes. While the bracket 96 has taken advantage of the preexisting mounting holes 32 for the actuator opening 30 in the brake beam 20, it may also be used with other brake beams.

The method of assembly of the present brake system to the preexisting brake beams 18 and 20 of a dual actuator system includes mounting bracket 42 to the first brake beam with the fasteners 44 and nuts 46 through holes 32. The brake actuator 40 with slack adjustor 48 can be previously mounted to the cage 50 which also can have been previously mounted to the bracket 42. While the actuator 40 is external the actuator aperture 30, the slack adjuster 48 extends through the actuator aperture 30 in the beam 18. The previously connected first force actuating element 90 would extend through the opening 38 in the bolster 22 and the force transmitting aperture 34 in brake beam 20. Bracket 96 is mounted to the second brake beam by fasteners 100 and nut 102. The transfer lever 94 is mounted to the bracket 96 and the other end of the rod 90 is connected to one arm of the transfer lever 94. The second force transmitting element 106 is extended through apertures 104 in the bracket 96 and aperture 30 in brake beam 20, through channel 38 in bolster 22 and into the aperture 34 in brake beam 18. A first end of force transmitting element 106 is connected to the transfer lever 94 and the other end is connected to the first brake beam 18 in the aperture 34.

Thus, a dual actuator, truck mounted brake can be converted to an improved single actuator, truck mounted brake using the existing brake beams. The reduced volume resulting from eliminating one fluid actuator is added to the actuator pipe to maintain the same cylinder pressure in an existing system.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A brake system for a railway vehicle comprising:

first and second brake beams;

a transfer lever pivotally connected at a point intermediate the ends thereof to said second brake beam;

first and second force transmitting means each having a second end connected to opposite arms of said transfer lever and a force transmitting axis, and a first end of said second force transmitting means being connected to said first brake beam;

actuator means connected to a first end of said first force transmitting means for controlling the position of said first force transmitting means along a force application axis in response to fluid pressure; and mounting means freely mounting said actuator means to said first brake beam for maintaining said actuator means force application axis coaxial with said first force transmitting means transmitting axis over the full operating range of said actuator means.

2. A brake system according to claim 1, wherein said actuator means includes a cylinder connected to said mounting means and a piston connected to said first force transmitting means.

3. A brake system according to claim 2, wherein said actuator means includes a slack adjustment means between said piston and said first force transmitting means.

4. A brake system according to claim 1, wherein said mounting means includes means for mounting said actuator means for horizontal movement about a predetermined vertical axis.

5. A brake system according to claim 4, wherein said mounting means includes means for mounting said actuator means for vertical movement about a predetermined horizontal axis.

6. A brake system according to claim 1, wherein said mounting means includes means for mounting said actuator means for vertical movement.

7. A brake system according to claim 1, wherein said mounting means includes a cage pivotally mounted to said first brake beam to pivot about a first axis and said actuator means is pivotally mounted to said cage to pivot about a second axis orthogonal to said first axis.

8. A brake system according to claim. 1, including a bracket mounted to said second brake beam and having an aperture aligned with a second aperture of said second brake beam; said second force transmitting means extends through said apertures; and said transfer lever is pivotally mounted to said bracket.

9. A method of converting a dual actuator brake system for a railway vehicle having first and second brake beams each with an actuator aperture having mounting holes about its periphery and a force transmitting aperture having mounting holes to a single actuator brake system comprising:

mounting an actuator with a first force transmitting means extending therefrom at said actuator aperture of said first brake beam so as to rotate about predetermined first and second orthogonal axis using said mounting holes of said actuator aperture and with said first force transmitting means extending through said force transmitting aperture in said second brake beam;

mounting a transfer lever pivotally to said second brake beam using said mounting holes of said actuator aperture;

connecting said first force transmitting means to an arm of said transfer lever;

inserting a second force transmitting means to extend through said actuator aperture of said second brake beam and into said force transmitting aperture of said first brake beam; and connecting said second force transmitting means to an opposite arm of said transfer lever and to said first brake beam using said mounting holes of said force transmitting aperture.

10. A method according to claim 9, wherein mounting said actuator includes mounting a cage to said first brake beam to pivot about said first axis and mounting said actuator means to said cage to pivot about said second axis orthogonal to said first axis.

11. A method according to claim 9, wherein mounting said actuator is mounted exterior said actuator aperture with a slack adjuster extending through said actuator aperture of said first brake beam.

12. A method according to claim 9, wherein mounting said transfer lever includes mounting a bracket, to which said transfer lever is pivotally mounted and having an aperture aligned with said actuator aperture of said second brake beam, to said second brake beam using said mounting holes of said actuator aperture.

13. A single actuator brake system for a railway vehicle comprising:

first and second brake beams each with a first aperture having mounting holes about its periphery and a second aperture;

actuator means with a first force transmitting means extending therefrom;

means for mounting said actuator means to said first brake beam so as to pivot about predetermined first and second orthogonal axis at said first aperture of said first brake beam using said mounting holes of said first aperture and with said first force transmitting means extending through said second aperture in said second brake beam;

transfer lever means pivotally connected to said second brake beam using said mounting holes of said first aperture of said second brake beam;

said first force transmitting means being connected to an arm of said transfer lever means; and second force transmitting means connected to an opposite arm of said transfer lever means, extending through said first aperture of said second brake beam and connected to said first brake beam at said second aperture of said first brake beam.

14. A brake system according to claim 13, wherein said mounting means includes a cage mounted to said first brake beam to pivot about said first axis and said actuator means is mounted to said cage to pivot about said second axis orthogonal to said first axis.

15. A brake system according to claim 13, wherein said actuator means is mounted exterior said first aperture of said first brake beam; and including a slack adjuster means connected between said actuator means and said first force transmitting means and through said first aperture of said first brake beam.

16. A brake system according to claim 13, wherein said transfer lever means includes a bracket, having an aperture aligned with said first aperture of said second brake beam, mounted to said second brake beam using said mounting holes of said first aperture of said second brake beam; and a transfer lever pivotally connected to said bracket at a point midway between the axis of said first and second apertures of said second brake beam.

* * * * *